US009388666B2

(12) United States Patent
Foong et al.

(10) Patent No.: US 9,388,666 B2
(45) Date of Patent: Jul. 12, 2016

(54) LOCKING MECHANISM FOR DOWNHOLE POSITIONING OF SLEEVES

(71) Applicant: HALLIBURTON ENERGY SERVICES, INC., Houston, TX (US)

(72) Inventors: Ryan Zhe Cong Foong, Shah Alam (MY); Vijay Kumar Keerthivasan, Singapore (SG); Daniel Lorng Yon Wong, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/397,536

(22) PCT Filed: Dec. 3, 2013

(86) PCT No.: PCT/US2013/072766

§ 371 (c)(1),
(2) Date: Oct. 28, 2014

(87) PCT Pub. No.: WO2015/084322

PCT Pub. Date: Jun. 11, 2015

(65) Prior Publication Data

US 2015/0152711 A1 Jun. 4, 2015

(51) Int. Cl.

| | |
|---|---|
| ***E21B 34/14*** | (2006.01) |
| ***E21B 34/10*** | (2006.01) |
| *E21B 34/00* | (2006.01) |

(52) U.S. Cl.
CPC ..... *E21B 34/14* (2013.01); *E21B 34/102* (2013.01); *E21B 2034/007* (2013.01)

(58) Field of Classification Search
CPC ..... E21B 34/14; E21B 2034/007
See application file for complete search history.

(56) References Cited

U.S. PATENT DOCUMENTS

| | | | | |
|---|---|---|---|---|
| 7,445,047 | B2 * | 11/2008 | Gomez | 166/334.4 |
| 7,866,402 | B2 | 1/2011 | Williamson, Jr. | |
| 8,505,639 | B2 | 8/2013 | Robison et al. | |
| 8,991,509 | B2 * | 3/2015 | Merron | 166/386 |
| 2009/0159264 | A1 | 6/2009 | Turner et al. | |
| 2009/0294124 | A1 | 12/2009 | Patel | |
| 2011/0042107 | A1 | 2/2011 | Chambers et al. | |

(Continued)

OTHER PUBLICATIONS

International Search Report and Written Opinion issued Sep. 1, 2014 for PCT Application No. PCT/US13/72766, 12 pages.

(Continued)

*Primary Examiner* — Nicole Coy
(74) *Attorney, Agent, or Firm* — Locke Lord LLP; Peter Fallon; Joshua L. Jones

(57) ABSTRACT

A well tool can include a chamber having a volume that changes when a member displaces, and a valve device that selectively opens and permits displacement of the member, and that selectively closes and prevents displacement of the member. A method of operating a well tool can include displacing a member, thereby changing a chamber volume, and then closing a valve device, thereby preventing displacement of the member. A well system can include a well tool connected in a tubular string, a flow passage of the tubular string extending longitudinally through the well tool, the well tool including a chamber having a volume that changes when a member displaces, and a shifting tool, a valve device opening and member displacement being permitted when the shifting tool engages the well tool, and the valve device closing and member displacement being prevented when the shifting tool disengages from the well tool.

9 Claims, 7 Drawing Sheets

(56) References Cited

U.S. PATENT DOCUMENTS

| | | | | |
|---|---|---|---|---|
| 2011/0297393 | A1* | 12/2011 | Patel | 166/373 |
| 2014/0000909 | A1* | 1/2014 | Neer | 166/373 |
| 2014/0262323 | A1* | 9/2014 | Cox et al. | 166/373 |

OTHER PUBLICATIONS

Halliburton, "FracDoore Sliding Side-Door® Circulation and Production Sleeve", H03877, data sheet dated Dec. 2010, 1 page.
Halliburton, "IB Series Mechanical Fluid Loss Isolation Barrier Valve", H06472, data sheet dated Sep. 2010, 2 pages.
Halliburton, "FS Fluid Loss Isolation Barrier Valve", H07007, data sheet dated Nov. 2013, 2 pages.
Halliburton, "Evo-Trieve® Intervention Packer", H07929, data sheet dated Apr. 2012, 2 pages.
Halliburton, "EquiFlow® Sliding Side-Door® Inflow Control Device", H08626, data sheet dated Aug. 2011, 2 pages.
Halliburton, "Packers", catalog, retrieved Oct. 17, 2014 from http://www.halliburton.com/public/cps/contents/books_and_catalogs/web/cpscatalog/06_Packers.pdf, 86 pages.
Halliburton, "Versa-Trieve® VBA Packer", Power Point Presentation, dated 2013, 35 pages.

* cited by examiner

LOCKING MECHANISM FOR DOWNHOLE POSITIONING OF SLEEVES

CROSS-REFERENCE TO RELATED APPLICATION

This application is a national stage under 35 USC 371 of International Application No. PCT/US13/72766, filed on 3 Dec. 2013. The entire disclosure of this prior application is incorporated herein by this reference.

TECHNICAL FIELD

This disclosure relates generally to equipment utilized and operations performed in conjunction with a subterranean well and, in one example described below, more particularly provides a locking mechanism for downhole positioning of sleeves and other members.

BACKGROUND

Well tools can sometimes be operated by displacing sleeves or other members of the well tools. However, it is usually undesirable for a well tool member to displace inadvertently. Therefore, it will be appreciated that improvements are continually needed in the arts of constructing and operating well tools with members that can be displaced when needed, and that do not displace inadvertently.

DETAILED DESCRIPTION

Figure 1:
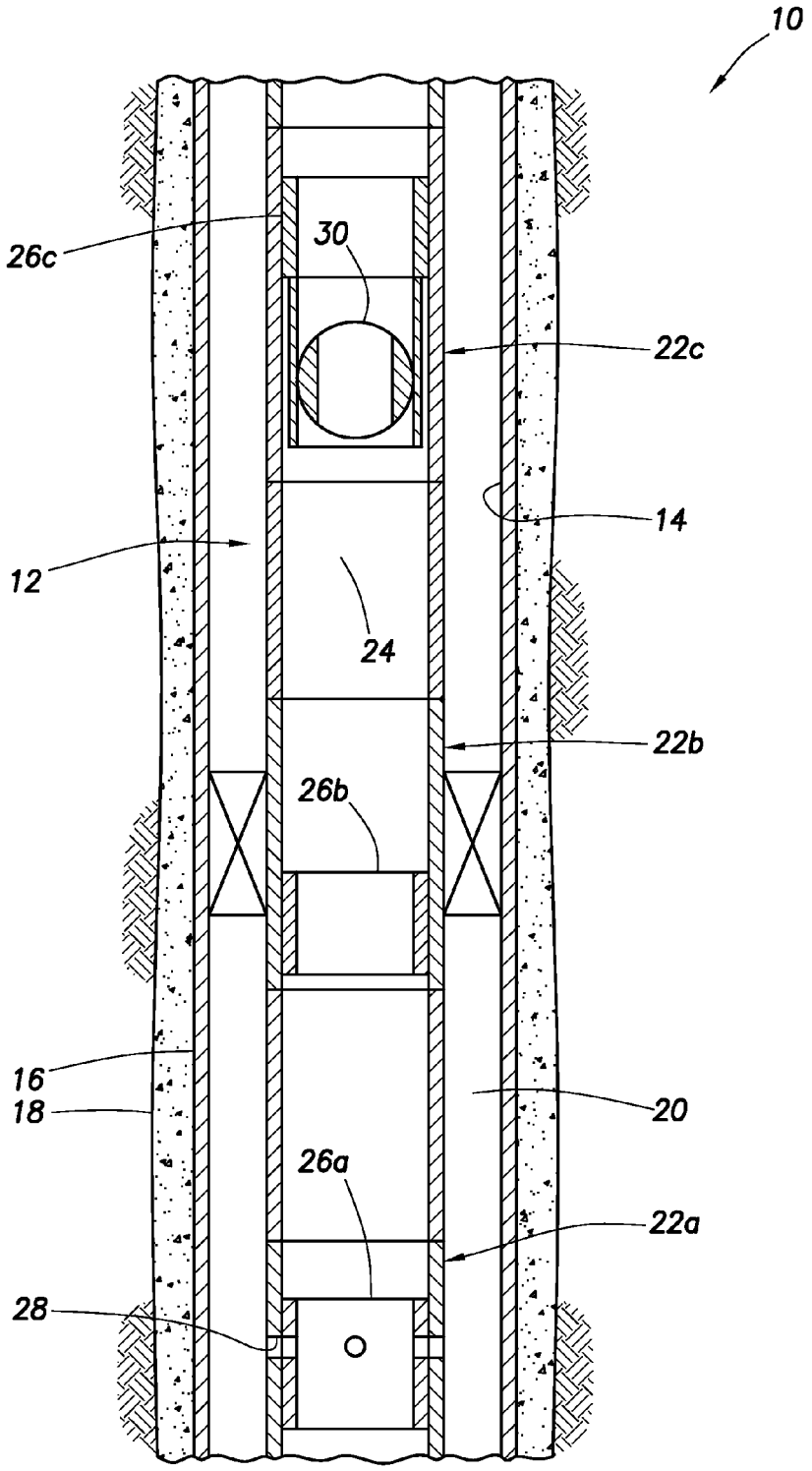
FIG. 1 is a representative cross-sectional view of a well system and associated method which can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is installed in a wellbore 14 lined with casing 16 and cement 18. An annulus 20 is formed radially between the tubular string 12 and the wellbore 14. In other examples, the wellbore 14 may be at least partially uncased or open hole, and the wellbore may be generally horizontal or at least deviated from vertical.

The tubular string 12 has various well tools 22*a-c* connected therein. In this example, the well tool 22*a* is a valve (such as, a production valve, an injection valve, a sliding side door or sliding sleeve valve, etc.) for providing selective fluid communication between the annulus 20 and a flow passage 24 extending longitudinally through the tubular string 12, the well tool 22*b* is a packer for sealing off the annulus 20, and the well tool 22*c* is a valve (such as, an isolation valve, a ball valve, etc.) for providing selective fluid communication through the flow passage. However, it should be clearly understood that any type of well tool can be used in the well system 10, and it is not necessary for the well tools to be connected in the tubular string 12 as depicted in FIG. 1.

The well tools 22*a-c* include respective members 26*a-c* that displace when the well tools are operated. The member 26*a* is a sliding sleeve that is displaced to selectively block and unblock flow through openings 28. The member 26*b* is a release sleeve that is displaced to unset the packer. The member 26*c* is an operator sleeve that is displaced to rotate a ball 30 between open and closed positions. However, any type of displaceable member may be used in keeping with the scope of this disclosure.

It is desirable to be able to displace each of the members 26*a-c*, in order to operate the respective well tools 22*a-c*. It is also desirable to prevent displacement of the members 26*a-c* when it is not desired to operate the well tools 22*a-c*. For this purpose, each of the well tools 22*a-c* can include a locking mechanism (not shown in FIG. 1) that selectively permits and prevents displacement of the respective member 26*a-c*.

Figure 2:
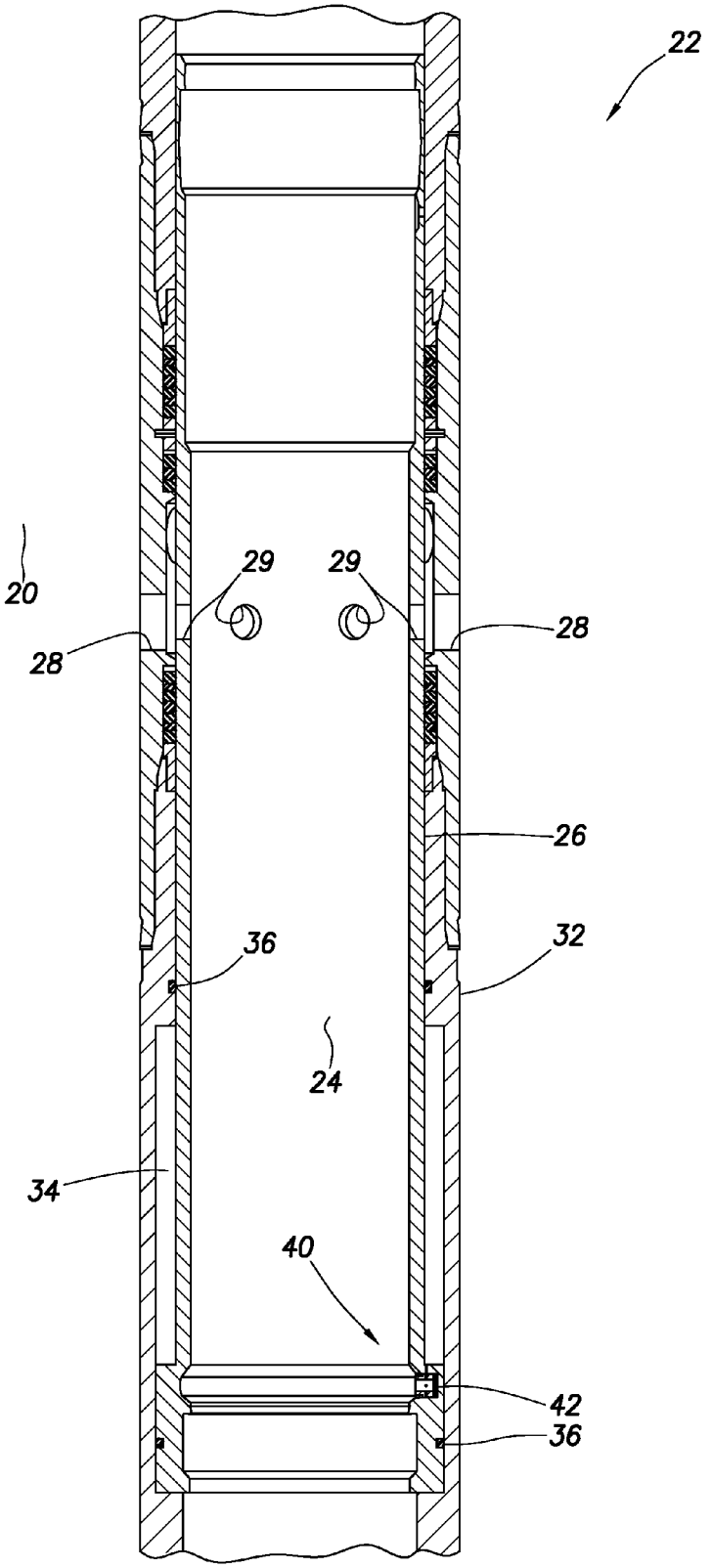
FIG. 2 is an enlarged scale representative cross-sectional view of a well tool that may be used in the system and method of FIG. 1, and which can embody the principles of this disclosure.

Referring additionally now to FIG. 2, a cross-sectional view of an example of a well tool 22 that may be used in the system 10 is representatively illustrated. The well tool 22 could be used for the well tool 22*a* in the system 10. However, other well tools (such as well tools 22*b* or 22*c*, or other types of well tools) can incorporate the principles of this disclosure, and the well tool 22 of FIG. 2 may be used in other well systems and methods in keeping with the principles of this disclosure.

In the FIG. 2 example, the well tool 22 includes a sleeve member 26 that is reciprocably displaceable in an outer housing assembly 32. In an open position of the sleeve member 26, fluid communication is permitted through longitudinally aligned openings 28 (in the outer housing assembly 32) and 29 (in the sleeve member 26) between the flow passage 24 and the annulus 20 external to the well tool 22.

A chamber 34 is formed in an annular space radially between the member 26 and the outer housing 32. Seals 36 isolate the chamber 34 from the flow passage 24. In this example, the chamber 34 is external to the member 26, but in other examples the chamber could be internal to the member, at one end of the member, or otherwise positioned relative to the member.

If the member 26 displaces upward as viewed in FIG. 2, a volume of the chamber 34 decreases, since a length of the chamber decreases. If the member 26 then displaces downward as viewed in FIG. 2, the volume of the chamber 34 will increase, since the length of the chamber will increase. Thus, the chamber 34 volume changes in response to displacement of the member 26.

In this example, the chamber 34 is filled with a substantially incompressible fluid (such as, hydraulic fluid, silicone fluid, well fluid, etc.). The chamber 34 could be filled with fluid prior to the well tool 22 being installed in the wellbore 14, or in some examples the chamber could fill with fluid as it is being installed in the wellbore.

The chamber 34 is part of a locking mechanism 40 that selectively permits and prevents displacement of the member 26. The locking mechanism 40 could similarly be used with any of the well tools 22*a-c* in the system 10 of FIG. 1, or with any other types of well tools.

In this example, the locking mechanism 40 is used to allow the member 26 to be displaced to its fully open position, to its fully closed position, or to any position between the open and closed positions. When such displacement is not desired, the locking mechanism 40 prevents displacement of the member 26.

In other examples, the assembly 32 could displace relative to the member 26, and the locking mechanism 40 could selectively permit and prevent such displacement of the assembly. Thus, the scope of this disclosure is not limited to displacement of any particular component relative to any other component.

The locking mechanism 40 includes a valve device 42 that selectively permits and prevents fluid communication between the flow passage 24 and the chamber 34. When such fluid communication is permitted, the member 26 can be displaced, since fluid can transfer into or out of the chamber 34. When such fluid communication is prevented, the member 26 cannot be displaced, since the incompressibility of the fluid in the chamber 34 prevents its volume from changing.

Figure 3:
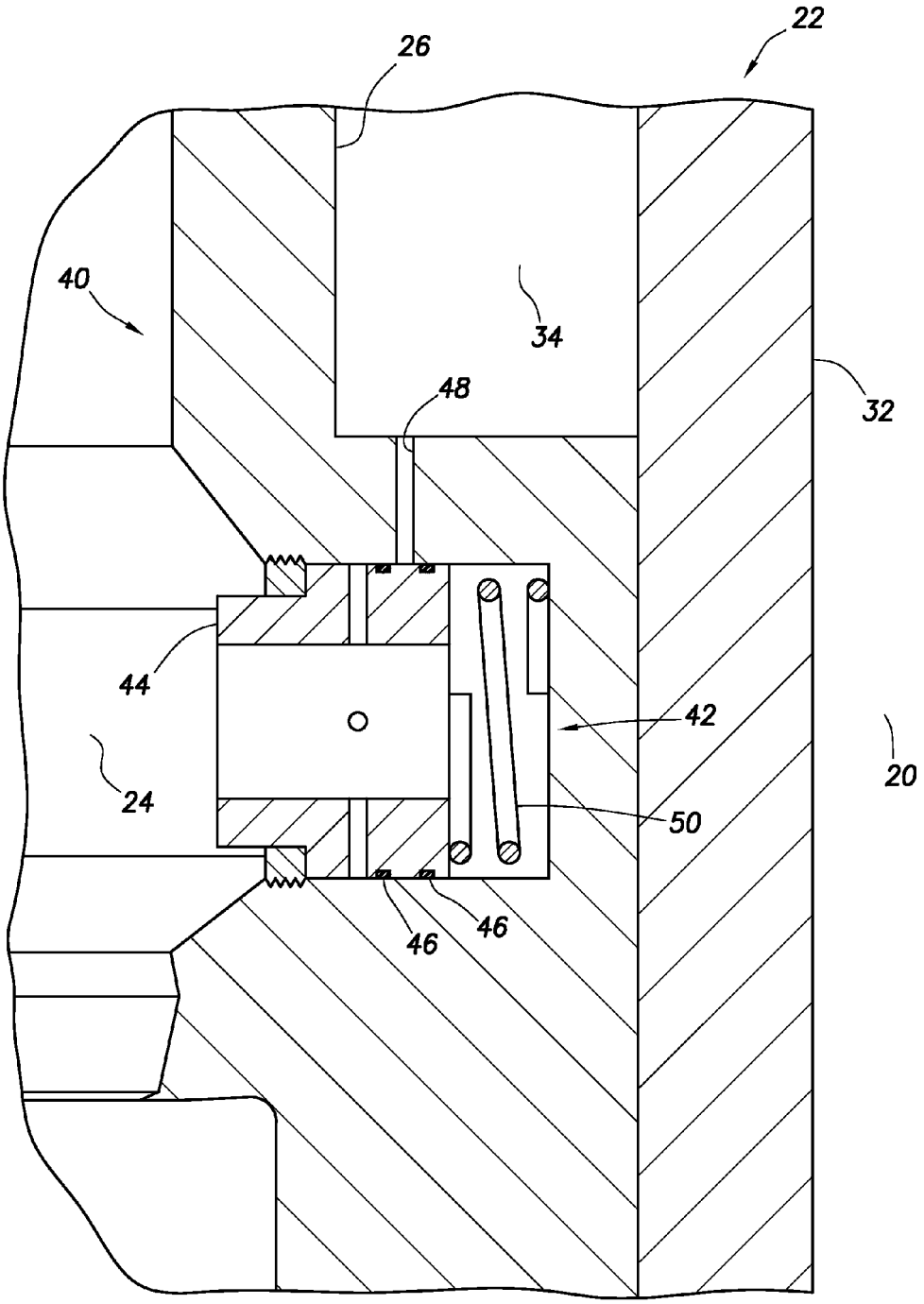
FIG. 3 is a further enlarged scale representative cross-sectional view of a valve device of the well tool, the valve device being depicted in a closed configuration.

Referring additionally now to FIG. 3, an enlarged scale cross-sectional view of the valve device 42 is representatively illustrated. In this view, it may be seen that the valve device 42 includes a generally hollow cylindrical closure 44. Seals 46 carried on the closure 44 straddle a port 48 in the member 26 and thereby prevent fluid communication between the flow passage 24 and the chamber 34.

In this closed position of the closure 44, the member 26 cannot be displaced. A biasing device 50 (such as, a compression spring, an elastomer, a compressed gas chamber, etc.) exerts a biasing force on the closure 44, in order to maintain the closure in its closed position.

Note that the closure 44 is pressure balanced. That is, fluid pressure applied to the closure 44 does not result in any net biasing force applied to the closure. Thus, the closure 44 does not displace in response to any increase or decrease in fluid pressure applied to the closure. This helps to prevent any inadvertent movement of the closure 44.

Figure 4:
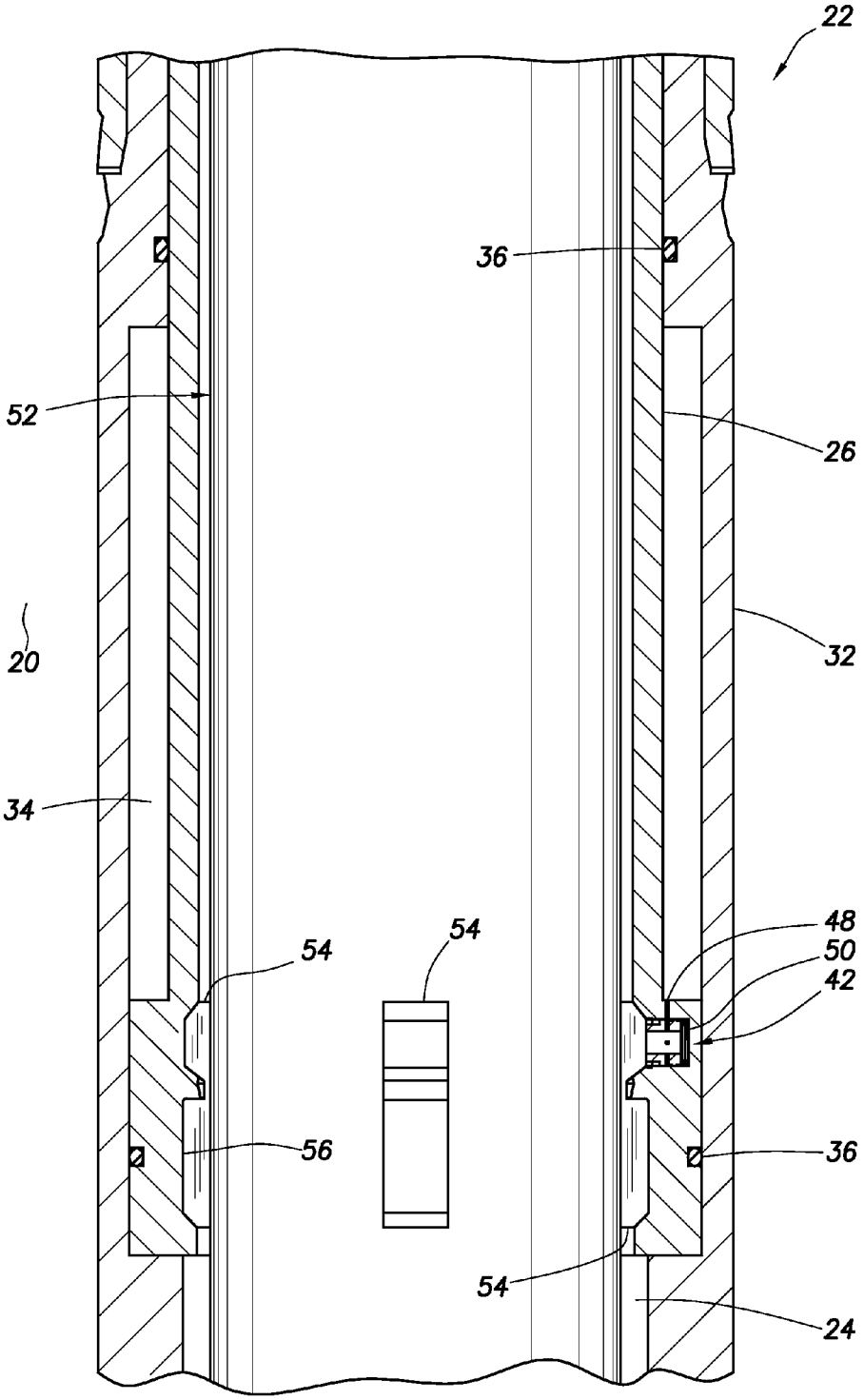
FIG. 4 is a representative partially cross-sectional view of the well tool with a shifting tool operatively engaged therein.

Referring additionally now to FIG. 4, the well tool 22 is representatively illustrated with a shifting tool 52 positioned in the flow passage 24. The shifting tool 52 is conveyed into the tubular string 12 (see FIG. 1) and engaged with the well tool 22 when it is desired to displace the member 26.

In the FIG. 4 example, the shifting tool 52 includes shifting dogs or keys 54 that are biased radially outward (e.g., by springs or other biasing devices in the shifting tool). In addition, the keys 54 are configured to complementarily engage a shifting profile 56 formed in the member 26. Such shifting tools are well known to those skilled in the art, and so the construction of the shifting tool 52 is not described further herein. If multiple well tools 22 are used, each well tool could have a unique shifting profile 56, so that only a complementarily shaped set of keys 54 will operatively engage the profile.

The closure 44 of the valve device 42 extends inwardly from the profile 56 so that, when the keys 54 engage the profile, the closure is biased outward by one of the keys. For example, an outward biasing force applied to the keys 54 by the shifting tool 52 can be greater than a biasing force exerted on the closure 44 by the biasing device 50, so that the closure displaces outward when the keys engage the profile 56.

Figure 5:
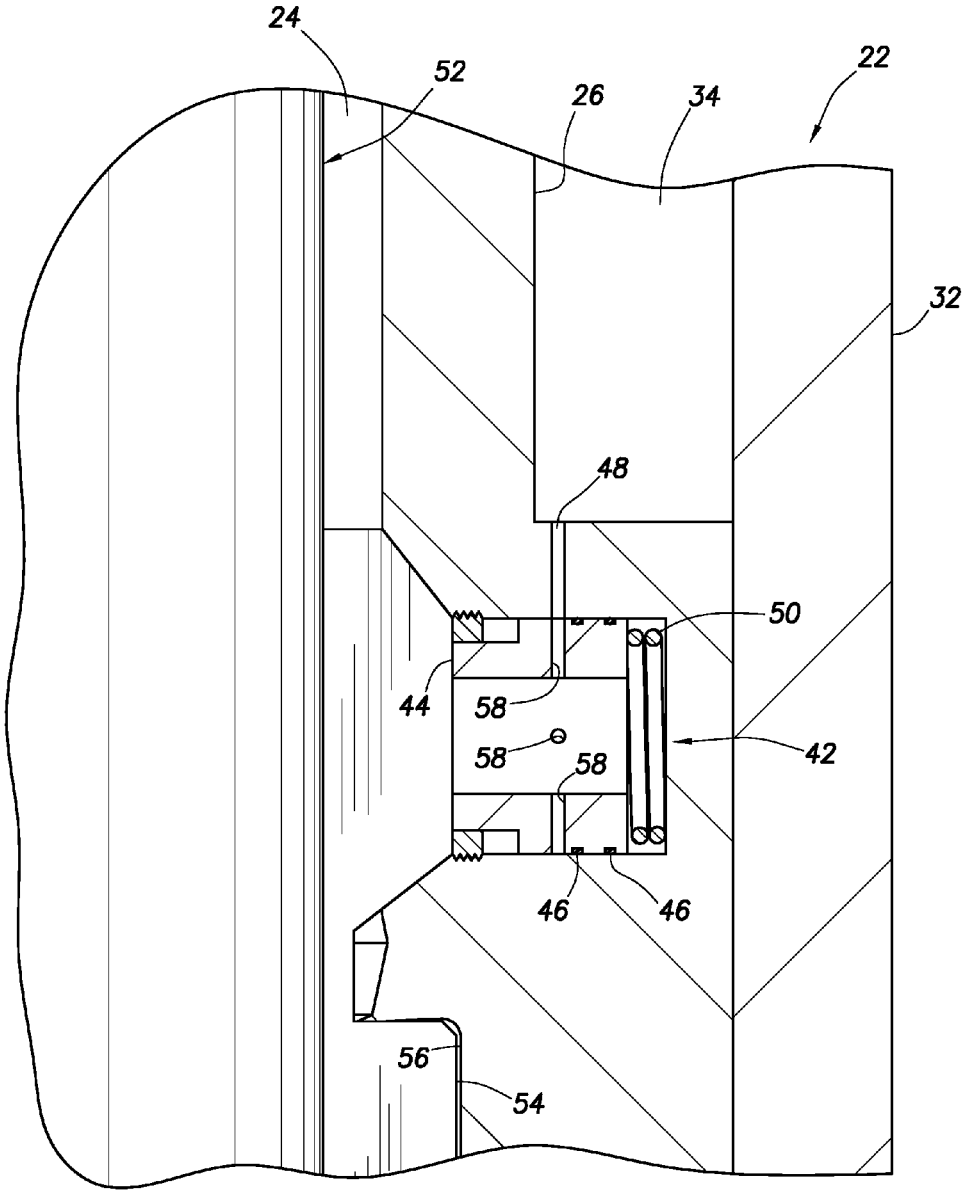
FIG. 5 is a representative partially cross-sectional view of the valve device opened by the shifting tool.

Referring additionally now to FIG. 5, an enlarged scale view of the valve device 42 is representatively illustrated. In this view, it may be seen how a key 54 contacts the closure 44 and displaces the closure outward against the biasing force exerted by the biasing device 50.

Note that the seals 46 on the closure 44 no longer straddle the port 48, and so fluid communication is now permitted between the flow passage 24 and the chamber 34. A port 58 formed through a sidewall of the closure 44 aligns with the port 48 to allow relatively unimpeded flow of fluid between the flow passage 24 and the chamber 34.

The shifting tool 52 can now be used to displace the member 26, for example, by raising the shifting tool in the flow passage 24. As the member 26 displaces with the shifting tool 52, fluid flows out of the chamber 34 and into the flow passage 24.

Figure 6:
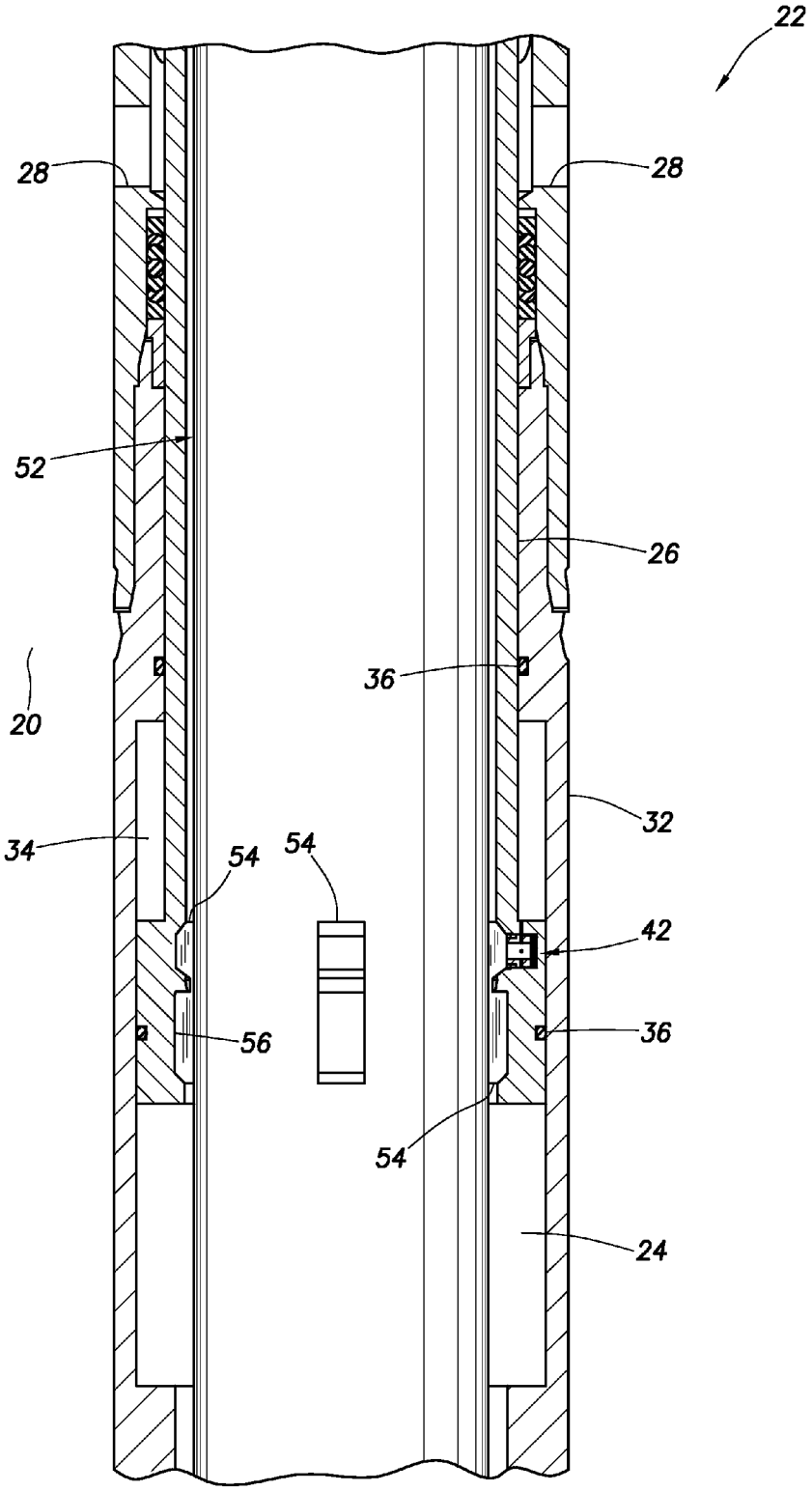
FIG. 6 is a representative partially cross-sectional view of the well tool with the shifting tool having displaced a sleeve member of the well tool.

Referring additionally now to FIG. 6, the well tool 22 is representatively illustrated after the shifting tool 52 has been used to displace the member 26 upwardly relative to the outer housing 32. Fluid communication through the openings 28 between the flow passage 24 and the annulus 20 is now prevented by the member 26.

Note that the volume of the chamber 34 has decreased. If the member 26 is displaced downwardly from this closed position, the volume of the chamber 34 will increase, and the open valve device 42 will permit fluid to flow from the flow passage 24 into the chamber.

The valve device 42 in this example remains open as long as the keys 54 are operatively engaged with the profile 56. The valve device 42 beneficially displaces with the shifting tool 52 and member 26, so that the valve device can be held open by the key 54 as the member is displaced by the shifting tool. However, in other examples, the valve device 42 does not necessarily displace with the member 26 (for example, the valve device could be positioned in a wall of the housing 32, etc.).

Figure 7:
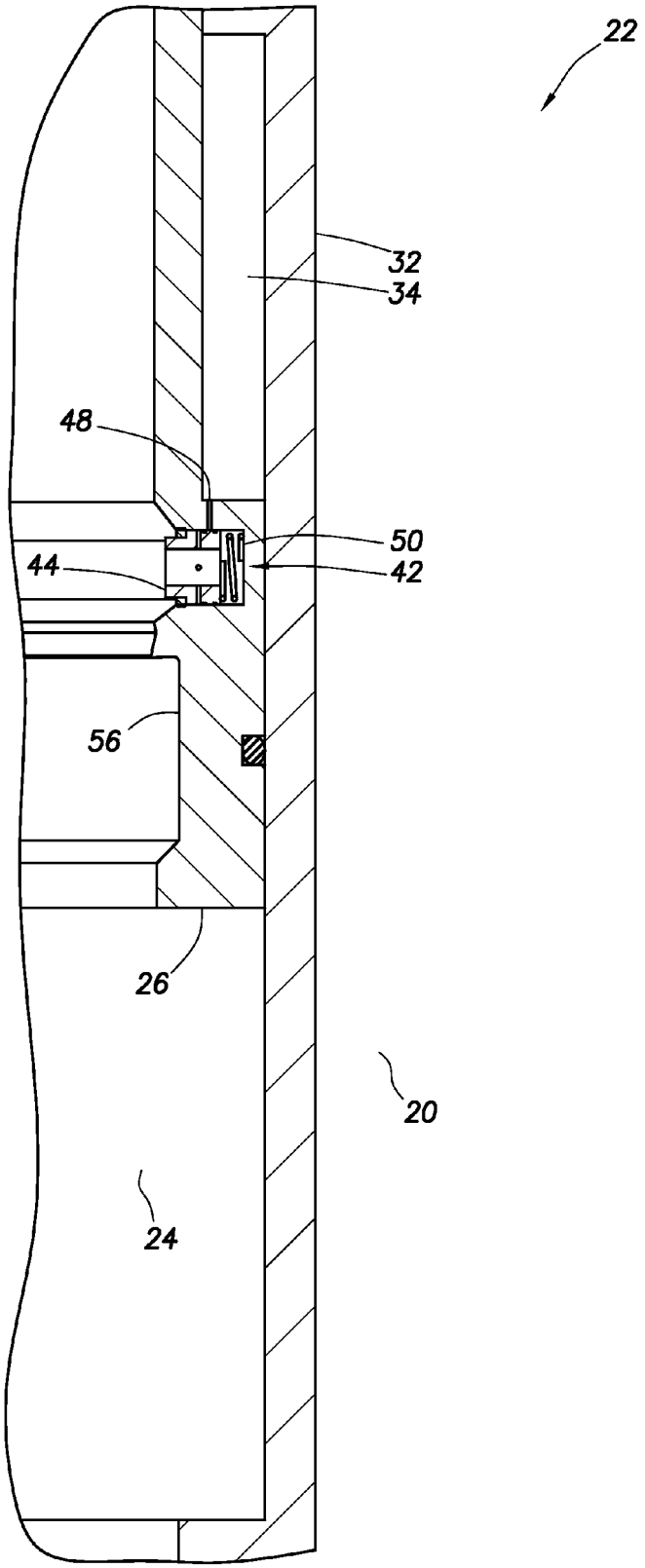
FIG. 7 is a representative cross-sectional view of the valve device in the well tool, the valve device being returned to the closed configuration.

Referring additionally now to FIG. 7, a portion of the well tool 22 is representatively illustrated after the shifting tool 52 has been disengaged from the well tool and retrieved from the passage 24. The biasing device 50 has displaced the closure 44 back to its closed position, and so fluid communication between the flow passage 24 and the chamber 34 is again prevented.

The member 26 is, thus, prevented from displacing away from its closed position. In order to downwardly displace the member 26 back to its open position (or to any position between its open and closed positions), the shifting tool 52 can again be engaged with the well tool 22 to open the valve device 42 and allow fluid communication between the flow passage 24 and the chamber 34.

Although the member 26 is depicted in the drawings as being a one-piece member, it will be appreciated that the member could include multiple individual elements connected together. Furthermore, it is not necessary for the member 26 to be cylindrical or sleeve-shaped.

Although the shifting tool 52 is described above as being used to open the valve device 42 and then displace the member 26, it will be appreciated that other tools or mechanisms could be used to open the valve device and/or to displace the member. For example, another type of tool (such as, a logging tool, a setting tool, etc.) could be used to open the valve device 42, and an actuator or biasing device could be used to displace the member 26. The valve device 42 does not necessarily extend inward from a shifting profile. Thus, the scope of this disclosure is not limited to use of the shifting tool 52.

It may now be fully appreciated that the above disclosure provides significant improvements to the arts of constructing and operating well tools with members that can be displaced when needed, and that do not displace inadvertently. In an example described above, the member 26 can be conveniently displaced when desired by engaging the shifting tool 52 in the well tool 22, or otherwise opening the valve device 42. However, the member 26 is prevented from displacing if the shifting tool 52 is not engaged in the well tool 22, or if the valve device 42 is not otherwise opened.

The above disclosure provides to the art a well tool 22. In one example, the well tool 22 can include a chamber 34 having a volume that changes in response to displacement of a member 26 of the well tool 22, and a valve device 42 that selectively opens and permits displacement of the member 26, and that selectively closes and prevents displacement of the member 26.

The valve device 42 may include a closure 44 that is pressure balanced. A biasing device 50 can bias the closure 44 toward a closed position.

The valve device 42 may displace with the member 26.

The chamber 34 can comprise an annular space formed external to the member 26. In other examples, the chamber 34 could be formed internal to the member 26.

The well tool 22 can include a flow passage 24 that extends longitudinally through the well tool. The valve device 42 may selectively permit and prevent fluid communication between the chamber 34 and the flow passage 24. In other examples, the valve device 42 could selectively permit and prevent fluid communication between the chamber 34 and other volumes (such as, the annulus 20, etc.).

The valve device 42 may extend at least partially into the flow passage 24. In other examples, the closure 44 could extend radially outward, longitudinally, or in other directions.

A method of operating a well tool 22 is also provided to the art by the above disclosure. In one example, the method comprises: displacing a member 26 of the well tool 22, thereby changing a volume of a chamber 34 of the well tool 22; and then closing a valve device 42 of the well tool 22, thereby preventing displacement of the member 26.

The method can also include opening the valve device 42, thereby permitting displacement of the member 26. The opening step may be performed after the closing step.

The displacing step can include displacing the member 26 with a shifting tool 52. The method may include opening the valve device 42 with the shifting tool 52 prior to the displacing step.

The method can include positioning the shifting tool 52 in a flow passage 24 that extends longitudinally through the well tool 22. The opening step can include permitting fluid communication between the flow passage 24 and the chamber 34. The opening step may be performed in response to a shifting key 54 of the shifting tool 52 engaging a profile 56 formed in the well tool 22.

A well system 10 is also described above. In one example, the well system 10 can include a well tool 22 connected as part of a tubular string 12, so that a flow passage 24 of the tubular string 12 extends longitudinally through the well tool 22. The well tool 22 includes a chamber 34 having a volume that changes in response to displacement of a member 26 of the well tool 22. A shifting tool 52 can be positioned in the flow passage 24. A valve device 42 of the well tool 22 is opened and displacement of the member 26 is permitted in response to engagement of the shifting tool 52 with the well tool 22. The valve device 42 is closed and displacement of the member 26 is prevented in response to disengagement of the shifting tool 52 from the well tool 22.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of operating a well tool, the method comprising the steps of:

(i) engaging a member of a well tool with a shifting tool and concurrently opening a valve device of the well tool with the shifting tool;

(ii) then displacing the member in a direction with the shifting tool, thereby changing a volume of a chamber of the well tool; and (iii) then closing the valve device, thereby preventing displacement of the member, optionally, reversing the direction of the member by performing steps (i), (ii), and (iii).

2. The method of claim 1, further comprising positioning the shifting tool in a flow passage that extends longitudinally through the well tool, and wherein the opening further comprises permitting fluid communication between the flow passage and the chamber.

3. The method of claim 1, wherein the opening is performed in response to a shifting key of the shifting tool engaging a profile formed in the well tool.

4. A well system, comprising:

a well tool connected as part of a tubular string, whereby a flow passage of the tubular string extends longitudinally through the well tool, the well tool including a chamber having a volume that changes in response to displacement of a member of the well tool; and a shifting tool positioned in the flow passage, and a valve device of the well tool being opened and displacement of the member in one of two directions being permitted in response to engagement of the shifting tool with the well tool, and the valve device being closed and displacement of the member being prevented in response to disengagement of the shifting tool from the well tool.

5. The well system of claim 4, wherein the valve device includes a closure that is pressure balanced.

6. The well system of claim 4, wherein the valve device includes a closure, and a biasing device that biases the closure toward a closed position.

7. The well system of claim 4, wherein the valve device displaces with the member.

8. The well system of claim 4, wherein the valve device selectively permits and prevents fluid communication between the chamber and the flow passage.

9. The well system of claim 4, wherein the valve device extends at least partially into the flow passage.

* * * * *